US005701714A

United States Patent [19]

Dietrichs

[11] Patent Number: 5,701,714

[45] Date of Patent: Dec. 30, 1997

[54] WROUGHT IRON GRATING ASSEMBLY

[75] Inventor: Alexander Dietrichs, Weinheim, Germany

[73] Assignee: bima Industrie-Service GmbH, Mannheim, Germany

[21] Appl. No.: 636,945

[22] Filed: Apr. 24, 1996

[30] Foreign Application Priority Data

Apr. 27, 1995 [DE] Germany ..... 295 07 111 U

[51] Int. Cl.[6] ..... E04C 2/38

[52] U.S. Cl. ..... 52/665; 52/660; 52/664; 52/720.3; 49/55; 49/50; 403/174; 403/218

[58] Field of Search ..... 52/669, 665, 720.3, 52/664, 660; 49/50, 55; 403/174, 218; 411/3, 5

[56] References Cited

U.S. PATENT DOCUMENTS

| | | | |
|---|---|---|---|
| 1,240,025 | 9/1917 | Carson | 49/55 |
| 1,279,747 | 9/1918 | Josler | 49/55 |
| 3,323,820 | 6/1967 | Braccini | 403/218 |
| 3,942,764 | 3/1976 | Beversdorf | 52/669 X |
| 3,948,013 | 4/1976 | Lobaugh et al. | 52/669 |
| 4,038,800 | 8/1977 | Daley | 49/55 X |
| 4,400,911 | 8/1983 | Bell et al. | 49/55 |
| 4,723,388 | 2/1988 | Zieg | 403/174 X |
| 4,881,354 | 11/1989 | Pitt | 49/50 X |

*Primary Examiner*—Carl D. Friedman
*Assistant Examiner*—Beth Aubrey
*Attorney, Agent, or Firm*—Henry M. Feiereisen

[57] ABSTRACT

A grille-type guard system, in particular a wrought iron grating assembly, includes a plurality of longitudinal bars in spaced-apart disposition, and a plurality of crossbars which are connected to the longitudinal bars at crossing points. The crossbars are formed at each crossing point with an arched section for receiving the longitudinal bars at least partially in a form-fitting manner, with the securement between the crossbars and the longitudinal bars being effected in each crossing point in non-detachable manner by a screw fastener that is received in aligned bores of the longitudinal bar and crossbar.

11 Claims, 1 Drawing Sheet

WROUGHT IRON GRATING ASSEMBLY

BACKGROUND OF THE INVENTION

The present invention refers to a grille-type guard system, and in particular to a wrought iron grating assembly.

Wrought iron gratings for windows, doors or banisters or the like are normally assembled on site from single elongate members, especially longitudinal bars and crossbars, or prefabricated parts of the grating assembly are already preassembled at the manufacturer's end and subsequently connected together. In either case, the longitudinal bars and the crossbars are welded together at the respective crossing points. Typically, the crossbars are formed in the area of the crossing points of outwardly arched configuration to exhibit an inner width and depth that is suited to the cross section of the longitudinal bars so that the longitudinal bars and crossbars of the finished grille extend substantially in a same plane.

A drawback of such a grating assembly is the necessity to employ an expert who is able to handle a required welding unit in order to assemble the grille on site.

SUMMARY OF THE INVENTION

It is an object of the present invention to provide an improved grille-type guard system, obviating the aforestated drawbacks.

In particular, it is an object of the present invention to provide an improved wrought iron grating assembly which can be assembled by a layperson without requiring any special tools.

These objects and others which will become apparent hereinafter are attained in accordance with the present invention by threadably connecting the crossbars and the longitudinal bars at the crossing points in a non-detachable manner.

Preferably, the threaded connection between the crossbars and the longitudinal bars is effected by a machine screw which is received in a bore of the longitudinal bars and an aligned tapped blind hole of the crossbars and includes a head which is secured in position to prevent an unscrewing of the machine screw. Suitably, the threaded connection is effected in the arched sections of the crossbars so that the longitudinal bars and the crossbars extend in a same plane.

A suitable machine screw for effecting the threaded connection is a screw that has a head with a hexagonal socket, such as an Allen screw, because after being inserted, this type of screw can be secured against detachment, by forcing a ball, e.g. a steel ball, into the hexagonal socket so that the socket becomes inaccessible for a tool (wrench). Certainly, any measures that prevent a tool from unscrewing the machine screw should be considered within the scope of the present invention. Examples include machine screws with removable head, or screws formed with surfaces that allow a torque only in direction of engagement.

Preferably, the bore in the longitudinal bar is enlarged by a counterbore to give it a flat bottom for fully receiving the head of the machine screw.

It is certainly also conceivable to effect the threaded connection between the longitudinal bars and the crossbars by forming the crossbars in each arched section with a throughbore which is traversed by a screw for engagement in a tapped blind hole of the longitudinal bars. It will also be understood by persons skilled in the art that the provision of a tapped blind hole may be substituted by a throughbore which is completely traversed by the screw shaft for engagement and securement in a nut that is of suitable configuration to also prevent a loosening and detachment by means of a tool, once the screw is threadably engaged to effect the connection between the crossbars and the longitudinal bars.

In order to provide a pleasing appearance, the threaded connection may be masked by decorating elements so as to be invisible from the outside.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
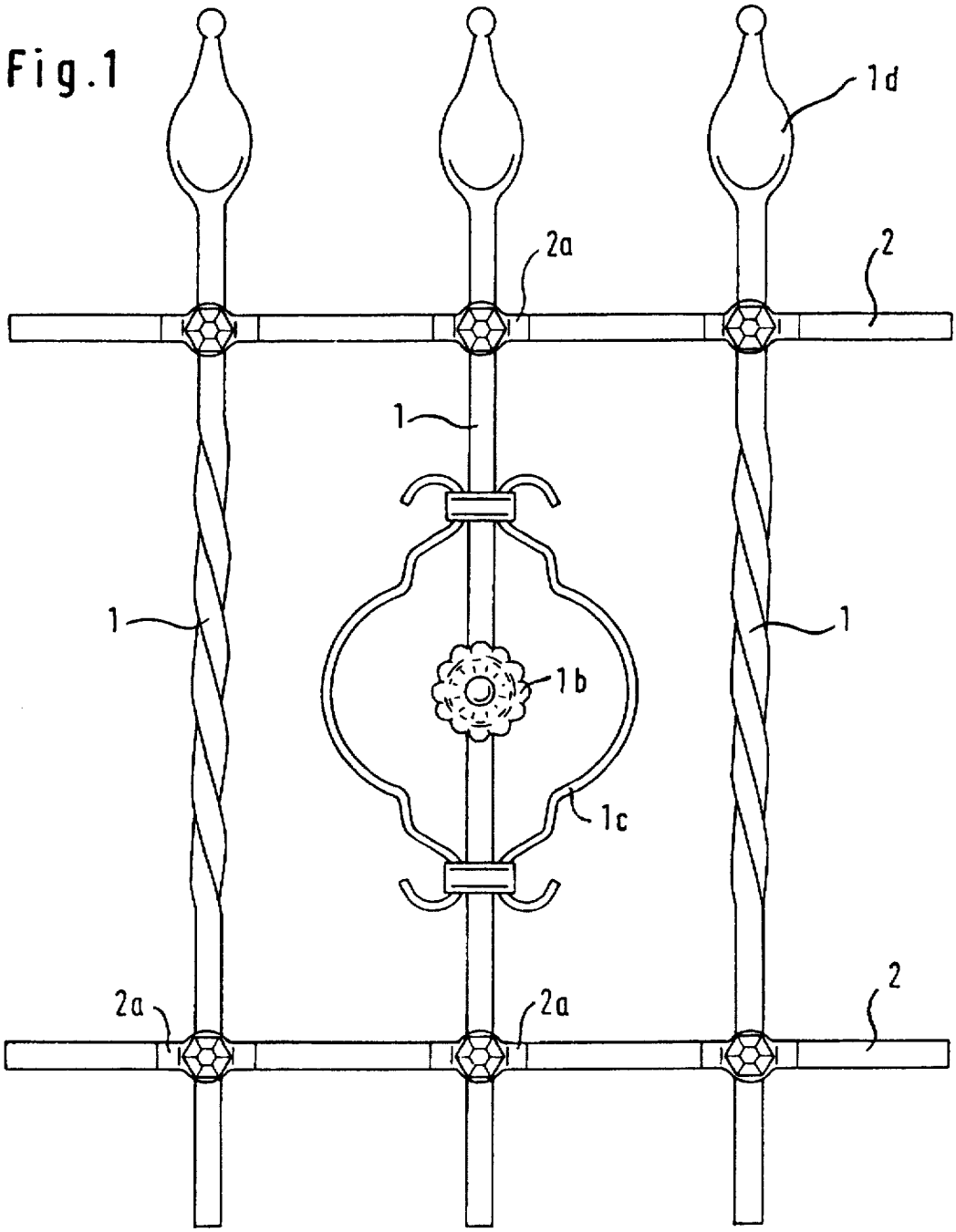
FIG. 1 is a front elevational view of a grating assembly according to the present invention.

Throughout all the Figures, the same or corresponding elements are always indicated by the same reference numerals.

Turning now to the drawing, and in particular to FIG. 1, there is shown a front elevational view of a wrought iron grating assembly according to the present invention in form of three longitudinal bars 1 which are connected to each other by two crossbars 2. For illustrative purposes, the nonlimiting example of FIG. 1 shows the outer longitudinal bars 1 formed with a twisted center section 1*a* while the middle bar 1 is decorated with a rosette 1*b* and an arcuate ornamentation 1*c*, with the longitudinal bars 1 terminating on top in finals 1*d*. It will be appreciated by persons skilled in the art that the decorative elements 1*a*, 1*b*, 1*c*, 1*d* are shown by way of example only, and the present invention should not be limited thereto.

The crossbars 2 are formed with arched sections 2*a* which exhibit an inner width and depth in correspondence to the cross section of the longitudinal bars 1 so that the longitudinal bars 1 and the crossbars 2 of the finished grille extend substantially in a single plane.

Figure 2:
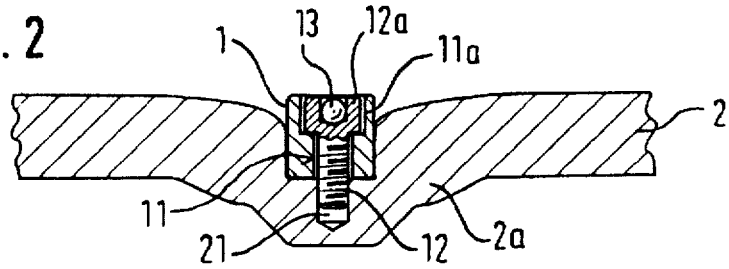
FIG. 2 is an enlarged, fragmentary cross sectional view of the area of connection between a longitudinal bar and a crossbar.

Referring now to FIG. 2, there is shown an enlarged, fragmentary cross sectional view of the area of connection between an exemplified longitudinal bar 1 and an exemplified crossbar 2 in the region of the arched section 2*a*. The longitudinal bar 1 is formed with a throughbore 11 which is enlarged by a counterbore 11*a* to receive the head 12*a* of a machine screw 12, preferably an Allen screw. Positioned in alignment with the throughbore 11 is a tapped blind hole 21 which is formed in the crossbar 2 for receiving the threaded shank of the screw 12.

When assembling the grating assembly according to the present invention, the bore 11 of the longitudinal bar 1 is aligned with the blind hole 21 of the crossbar 2, and the Allen screw 12 is threadably engaged in the thus-aligned bores, with the head 12 being received flush within the counterbore 11*a*. Subsequently, a sphere 13, e.g. as steel ball, is forced into the hexagonal socket of the head 12*a* to secure the Allen screw 12 in position and to prevent a subsequent detachment by a tool.

Persons skilled in the art will understand that it is certainly within the scope of the present invention to effect the threaded connection between the longitudinal bars 1 and the crossbars 2 in such a manner that the crossbars are formed in each arched section with a throughbore which is traversed by a screw for engagement in a tapped blind hole of the longitudinal bars 1. It will also be understood by persons skilled in the art that the provision of a tapped blind hole is described by way of example only and may be substituted by a throughbore which is completely traversed by the screw shaft so that the screw is secured by a nut (not shown) that is of suitable configuration to prevent a loosening and detachment by means of a tool, once the screw is threadably engaged to effect the connection between the crossbars and the longitudinal bars.

Additionally, persons skilled in the art will understand that the securement of the screw may also be effected in a different manner as described herein, e.g. by machine screws with removable head, or screws formed with surfaces that allow a torque only in direction of engagement While the invention has been illustrated and described as embodied in a wrought iron grating assembly, it is not intended to be limited to the details shown since various modifications and structural changes may be made without departing in any way from the spirit of the present invention.

What is claimed as new and desired to be protected by Letters Patent is set forth in the appended claims:

1. A wrought iron grating assembly, comprising:

a plurality of longitudinal bars in spaced-apart relationship;

a plurality of crossbars connection to the longitudinal bars, each one of the crossbars being formed at a crossing point with the longitudinal bars with an arched section receiving the longitudinal bars at least partially in a form-fitting manner;

threaded fastening means attaching the crossbars to the longitudinal bars at each crossing point; and means for non-detachably securing the fastening means in place.

2. The grating assembly of claim 1 wherein each crossbar is formed with a threaded blind hole in the area of the crossing points and each longitudinal bar exhibits a bore in alignment with the threaded blind hole, said threaded fastening means including a machine screw received in the aligned blind hole and bore of the longitudinal bar and crossbar.

3. The grating assembly of claim 2 wherein the machine screw is an Allen screw exhibiting a hexagonal socket.

4. The grating assembly of claim 2 wherein the machine screw has a head, said longitudinal bar being formed with a counterbore for receiving the head of the machine screw.

5. The grating assembly of claim 3 wherein said securing means includes a steel ball forced into the hexagonal socket of the Allen screw.

6. The grating assembly of claim 1 wherein the longitudinal bars and the crossbars are formed at each crossing point with aligned bores, said threaded fastening means including a screw received in the aligned bores.

7. A grille-type guard system, comprising:

first elongate members extending in spaced-apart relationship;

second elongate members extending in spaced-apart relationship and connected to the first elongate members at crossing points, said first elongate members being formed at each crossing point with an arched section for receiving the second elongate members at least partially in a form-fitting manner;

threaded fastening means attaching the first and second elongate members to one another in each crossing point; and means for non-detachably securing the fastening means in place.

8. The guard system of claim 7 wherein the first and second elongate members are formed at each crossing point with aligned bores, said threaded fastening means including a screw received in the aligned bores.

9. The guard system of claim 7 wherein the screw is an Allen screw.

10. The guard system of claim 8 wherein the screw has a head, one of the first and second elongate members being formed with a counterbore for receiving the head of the screw.

11. The guard system of claim 9 wherein said fastening means includes a steel ball forced into the hexagonal socket of the Allen screw.

* * * * *